US012127645B2

(12) United States Patent
Luo

(10) Patent No.: US 12,127,645 B2
(45) Date of Patent: Oct. 29, 2024

(54) UMBRELLA CAPABLE OF CANOPY ADJUSTMENT THROUGH A HANDLE

(71) Applicant: Phaeton Manufacturing LLC, Nantong (CN)

(72) Inventor: Xiong Luo, Nantong (CN)

(73) Assignee: Phaeton Manufacturing LLC, Nantong (CN)

( * ) Notice: Subject to any disclaimer, the term of this patent is extended or adjusted under 35 U.S.C. 154(b) by 169 days.

(21) Appl. No.: 18/001,654

(22) PCT Filed: Jun. 23, 2021

(86) PCT No.: PCT/CN2021/101677
§ 371 (c)(1),
(2) Date: Dec. 13, 2022

(87) PCT Pub. No.: WO2021/259296
PCT Pub. Date: Dec. 30, 2021

(65) Prior Publication Data

US 2023/0292891 A1 Sep. 21, 2023

(30) Foreign Application Priority Data

Jun. 24, 2020 (CN) ..... 202021208084.5

(51) Int. Cl.
*A45B 17/00* (2006.01)
*A45B 23/00* (2006.01)

(52) U.S. Cl.
CPC ..... *A45B 17/00* (2013.01); *A45B 23/00* (2013.01); *A45B 2023/0012* (2013.01);
(Continued)

(58) Field of Classification Search
CPC . A45B 17/00; A45B 23/00; A45B 2023/0012; A45B 2023/0031;
(Continued)

(56) References Cited

U.S. PATENT DOCUMENTS 9,289,038 B2 * 3/2016 Ma ..... A45B 25/08
2006/0243311 A1 * 11/2006 Glatz ..... A45B 23/00 135/120.2

(Continued)

FOREIGN PATENT DOCUMENTS

CN 109380831 A * 2/2019 ..... A45B 17/00
DE 102008034985 A1 * 2/2010 ..... A45B 17/00

OTHER PUBLICATIONS 6 page PDF of English translation of the the Aug. 30, 2021 Written Opinion for PCTCN/2021/101677. (Year: 2021).*

(Continued)

*Primary Examiner* — Robert Canfield
(74) *Attorney, Agent, or Firm* — Wang Law Firm, Inc.

(57) ABSTRACT

An umbrella with an adjustable canopy comprises a canopy adjustment device having a transverse rod connector, an upper clutch gear, a lower clutch gear and a handle; and a transverse rod rotation device disposed on the middle of a transverse rod; the front end of a tilted rod is rotatably connected to the transverse rod rotation device; the bottom end of the transverse rod is rotatably connected to a sliding block through the canopy adjustment device. The upper clutch gear is fixedly connected to the transverse rod; the bottom end of the transverse rod connector is rotatably connected to the sliding block; one end of the handle is rotatably connected to the periphery the upper clutch gear which is against the upper surface of the lower clutch gear. The invention has the advantages of simple and reasonable structure, convenient operation, stable and reliable positioning, and can realize the canopy adjustment only by operating the handle.

9 Claims, 5 Drawing Sheets

(52) U.S. Cl.
CPC ..... *A45B 2023/0031* (2013.01); *A45B 2023/0037* (2013.01); *A45B 2023/0075* (2013.01); *A45B 2023/0081* (2013.01)

(58) Field of Classification Search
CPC .... A45B 2023/0037; A45B 2023/0075; A45B 2023/0081; A45B 2023/005; A45B 25/02
USPC ..... 135/20.1, 20.3
See application file for complete search history.

(56) References Cited

U.S. PATENT DOCUMENTS

| | | | | |
|---|---|---|---|---|
| 2015/0059815 | A1* | 3/2015 | Xiong | A45B 23/00 135/20.1 |
| 2015/0068566 | A1* | 3/2015 | Ma | A45B 23/00 135/20.1 |
| 2016/0166022 | A1* | 6/2016 | Luo | A45B 25/08 135/98 |
| 2016/0183647 | A1* | 6/2016 | Ma | A45B 23/00 135/20.1 |
| 2021/0386166 | A1* | 12/2021 | Luo | A45B 25/02 |
| 2022/0007801 | A1* | 1/2022 | Roberts | A45B 25/02 |
| 2022/0079308 | A1* | 3/2022 | Xie | A45B 23/00 |
| 2024/0108109 | A1* | 4/2024 | Xie | A45B 23/00 |

OTHER PUBLICATIONS 18 page English translation of DE 102008034985 (D1 cite in the parent written opinion). (Year: 2010).*

* cited by examiner

UMBRELLA CAPABLE OF CANOPY ADJUSTMENT THROUGH A HANDLE

TECHNICAL FIELD OF THE INVENTION

The present invention relates to the technical field of an umbrella, in particular to an umbrella which can rotate left and right.

BACKGROUND OF THE INVENTION

As an outdoor leisure appliance, umbrella is widely used in square, beach, park, courtyard and other leisure places, providing people with comfortable cool space. At present, the position of the canopy is usually fixed and cannot be adjusted. However, with the change of wind direction and the inclination of sunlight, if the angle of the canopy can also be adjusted and changed, it can achieve better shading and wind proofing effect. In order to meet this demand, there are also many umbrellas with adjustable canopy.

After searching, a Chinese patent CN202552458U (patent No.: CN201220168486.6) disclosed "canopy adjustment mechanism for umbrella" was found. The canopy adjustment mechanism comprises a housing which is sleeved on the bending arm of the umbrella and connected with the column and the big bending arm of the umbrella. The top end of the column is connected with the bottom end of the big bending arm through the housing. It is characterized in that: the mating surface of the big bending arm has a groove along the length direction, and a synchronous belt is arranged in the groove. The middle part of the inner side of the bending arm has a pin assembly which is engaged and positioned with the gear position on the synchronous belt. One end of the pin assembly is connected with the handle through a steel wire rope, and the handle drives the pin assembly to separate from the synchronous belt, so as to realize the adjustment of the bending arm. This adjustment method realizes the adjustment of the canopy by adjusting the bending arm. The structure is complex, troublesome with high cost, and the operation is not very convenient.

Another Chinese patent CN203538551U (patent No.: CN201320541314.3), disclosed "an umbrella with left and right adjustable sunshade angle" was found. The umbrella comprises a base, a column, a transverse rod, a tilted rod and an umbrella frame. The bottom end of the transverse rod is disposed on the column, the top end of the transverse rod is connected with the top of the umbrella frame, the rear end of the tilted rod is connected to the top of the column, the front end of the tilted rod is connected to the middle of the transverse rod, and the column is inserted on the umbrella base, wherein the top of the umbrella frame is rotatably connected with the top end of the transverse rod through a rotating device; The column is sleeved with a sliding seat, the bottom end of the transverse rod is connected with the sliding seat through a lower connector of the transverse rod, a canopy adjustment device is disposed between the lower connector of the transverse rod and the transverse rod, and an extended rod is set on the umbrella frame, and the bottom end of the extended rod is connected with the canopy adjustment device. This kind of umbrella drives the rotation of the umbrella frame through the rotation of a clutch gear sleeve, which can adjust the sunshade angle in a segmentless way from left to right. However, the clutch gear sleeve is only set at the bottom end of the extended rod, and the structure is not stable enough. The handle is a sleeve, which is not convenient enough to use, and the structure needs further improvement.

SUMMARY OF THE INVENTION

It is an object of the present invention to provide an umbrella with an adjustable canopy with a compact and reasonable structure, which can achieve a left and right adjustment of the sunshade angle of the canopy, and the operation is simple and convenient.

For achieving the above object, the umbrella with an adjustable canopy comprises a column; a sliding block slidably mounted onto the column; an umbrella frame; a transverse rod having a top end and a bottom end; a tilted rod having a rear end and a front end; a canopy adjustment device for controlling the rotation of the umbrella frame; a transverse rod rotation device mounted on the middle of the transverse rod, being capable of rotating the transverse rod when the tilted rod is stationary; wherein, the bottom end of the transverse rod is rotatably connected to the sliding block through the canopy adjustment device, the top end of the transverse rod is rotatably connected to the top of the umbrella frame; the rear end of the tilted rod is connected to the top of the column, and the front end of the tilted rod is rotatably connected to the middle of the transverse rod; the front end of the tilted rod is rotatably connected to the transverse rod rotation device; the canopy adjustment device comprises a transverse rod connector having a top end and a bottom end, a lower clutch gear surrounding the transverse rod connector and having an upper surface, an upper clutch gear and a handle; the upper clutch gear is fixedly connected to the transverse rod; the top end of the transverse rod connector passes through the lower clutch gear and is rotatably connected to the upper clutch gear; the lower clutch gear moves along the axis of the transverse rod connector to engage or disengage with the upper clutch gear; one end of the handle is rotatably connected to the periphery the upper clutch gear, which is against the upper surface of the lower clutch gear; when the handle is rotated downward, the handle drives the lower clutch gear to move downward and separate from the upper clutch gear, then, when the handle is rotated leftward or rightward, the transverse rod and the umbrella frame is driven to move leftward or rightward for achieve a canopy adjustment.

Preferably, each of the upper clutch gear and the lower clutch gear is a sleeve and has a through hole, the upper clutch gear has a circular hole at the bottom end thereof for the transverse rod connector to pass through, and the lower clutch gear has a square hole at the upper end thereof for receiving the top of the transverse rod connector; the upper clutch gear has a circular protruding teeth around the circular hole, the lower clutch gear has a circular convex teeth around the square hole at the top end thereof for engaging with the circular protruding teeth; the transverse rod connector has a square portion matching with the square hole of the lower clutch gear, the top of the transverse rod connector passes through the square hole of the lower clutch gear and the circular hole of the upper clutch gear, and a nut located inside through hole of the upper clutch gear is screwed on the top of the transverse rod connector, the lower clutch gear and the upper clutch gear are positioned around the transverse rod connector; a spring is supported between the inner wall of through hole of the lower clutch gear and the transverse rod connector, so as to push the lower clutch gear to move upward and engage with the upper clutch gear.

Preferably, the transverse rod connector is defined with five sections from the bottom to the top, those are a first section, a second section, a third section, a fourth section, a fifth section; the first section is a connecting section connected with the sliding block, the second section is a cylindrical section matching the through hole of the lower clutch gear, and the third section in the middle of the transverse rod connector is a square column section matching the square hole of the lower clutch gear, the fourth section is a reduced cylindrical section matching the circular hole of the upper clutch gear, and the fifth section is an external thread section matching the nut; the spring is sleeved on the third square column section of the transverse rod connector, two ends of the spring respectively resist against the inner side of the square hole of the lower clutch gear, and the front surface of the second section of the transverse rod connector.

Preferably, the upper clutch gear has two fixed grooves each for receiving bearings respectively disposed on the top end and the bottom end of the circular hole; the top end of the transverse rod connector passes through the spring and the upper clutch gear and is located inside the bearings; the third section of the transverse rod connector is positioned resisting against the bearing at the bottom end of the upper clutch gear, the fourth section of the transverse rod connector fits closely with the bearing.

Preferably, the upper clutch gear has a handle groove for receiving a top end of the handle at the bottom end of the upper clutch gear, the top end of the handle is U-shaped and has a cam surface; the top end of the handle has a transverse handle through hole, the upper clutch gear has a corresponding rotating holes at each of two sides of the handle groove; a torsion spring having a center hole matched with the handle is disposed between the top end of the handle and the handle groove; a screw passes through the rotating holes, the handle through hole of the handle and the center hole of the torsion spring so as to make the handle and the torsion spring be positioned on the upper clutch gear.

Preferably, a washer in sliding connected to the top end of the handle is disposed on the top surface of the lower clutch gear.

Preferably, the upper clutch gear has a clutch gear cover at the top end thereof, the transverse rod is a hollow square tube; the clutch gear cover has a square hole for receiving the transverse rod, the bottom end of the transverse rod has a connecting hole, the top end of the upper clutch gear has a corresponding transverse rod fixing hole and the clutch gear cover has a corresponding through hole; the transverse rod and the clutch gear cover are positioned on the upper clutch gear through a screw.

Preferably, the transverse rod rotation device comprises a plurality pair of left rotation bushing and right rotation bushing and a tilted rod connector; each of the left and right rotation bushings is in semicircular, and one pair of the left and right rotation bushings face to face assembled forms a clamp with a square hole matching with the transverse rod; the middle of the transverse rod has a through mounting hole, the middle of the left and right rotation bushings has a plurality of corresponding through holes; the left and right rotation bushings are clamped at the left and right sides of the middle of the transverse rod and are positioned with the transverse rod through a screw and a nut; the tilted rod connector is rotatably sleeved out of the left and right rotation bushings, the tilted rod connector is a circle matching with the left and right rotation bushings, and the top of the tilted rod connector is rotatably connected to the bottom end of the tilted rod.

Preferably, two pairs of the left and right rotation bushings are respectively located at the two ends of the tilted rod connector; and each pair of left and right rotation bushings has a protruding edge resisting against one end of the circular tilted rod connector, each pair of the left and right rotation bushings has circular concave convex texture at the peripheral surface thereof which is convenient for increasing friction.

Preferably, the bottom end of the upper clutch gear has a mark line at the periphery thereof; the lower clutch gear has a scale mark disposed around the top end of the lower clutch gear, which is matched with the mark line to observe the left and right rotation angles.

Compared with the prior art, the present invention has the following beneficial effects. Under the design of the canopy adjustment device and the transverse rod rotation device, the transverse rod rotation device can drive the transverse rod to rotate when the tilted rod is stationary. And the canopy adjustment device comprises a transverse rod connector, a upper clutch gear, a lower clutch gear and a handle. When the handle is rotated downward, the handle drives the lower clutch gear to move downward and separate from the upper clutch gear, so as to achieve a canopy adjustment to adjust the sunshade angle of the canopy. The present invention has the advantages of simple and reasonable structure, convenient operation, stable and reliable positioning, and can realize the canopy adjustment only by operating the handle. The operation mode is more simple and convenient, and has strong practical performance.

DETAILED DESCRIPTION OF THE INVENTION

The present invention will be further described in detail with reference to the accompanying drawings by embodiments.

Figure 1:
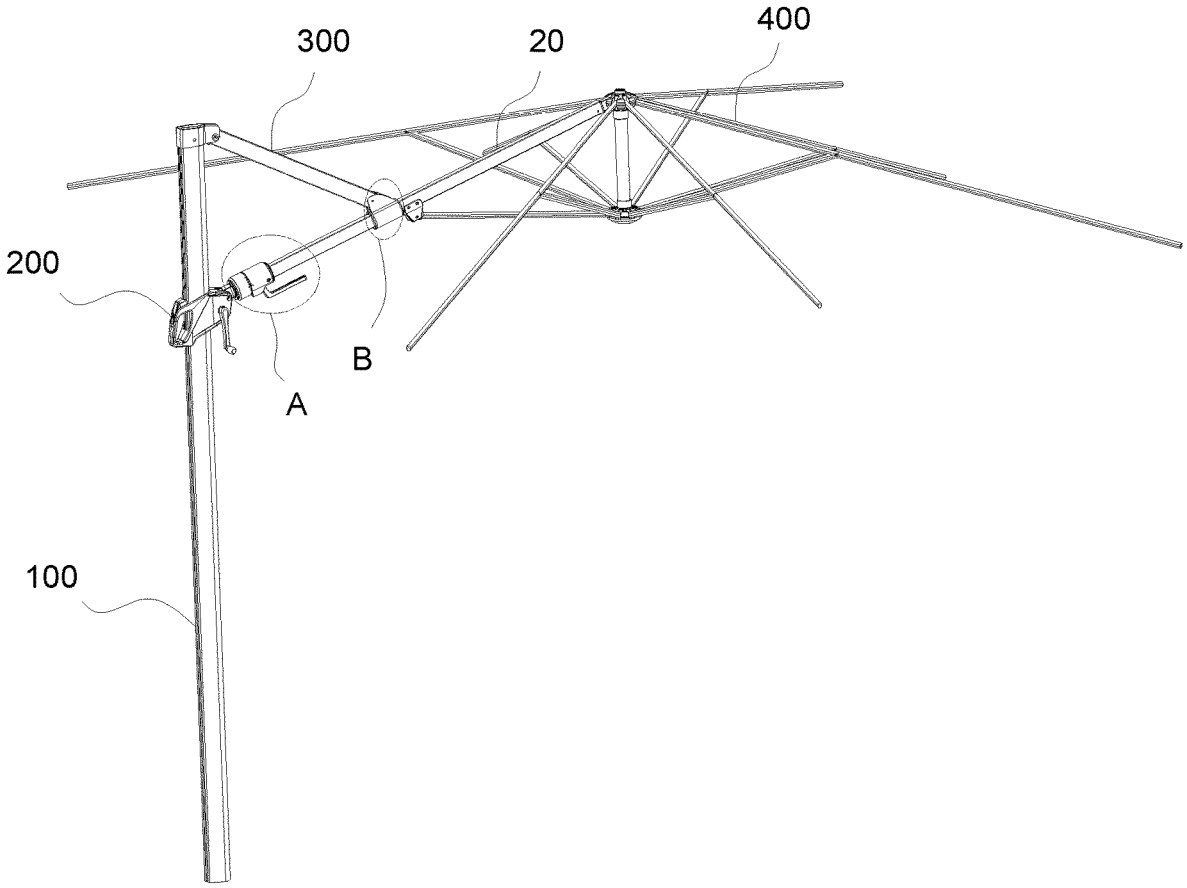
FIG. 1 is a perspective view of an umbrella according to an embodiment of the present invention.
Figure 2:
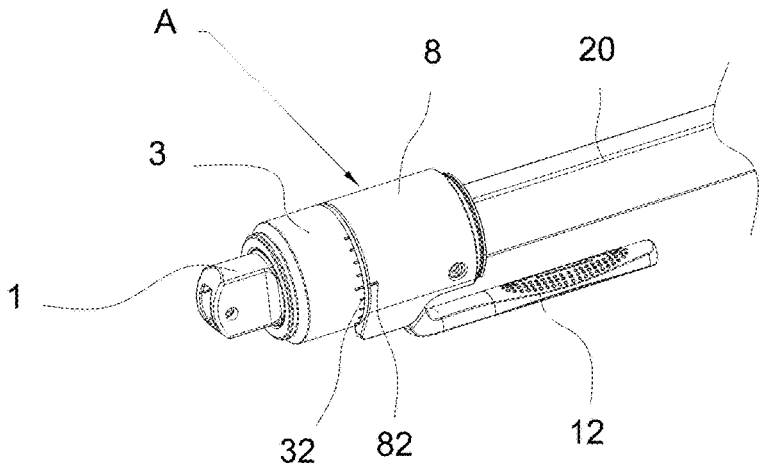
FIG. 2 is an enlarged view of Part-A showing the canopy adjustment device in FIG. 1 according to the embodiment of the present invention.
Figure 3:
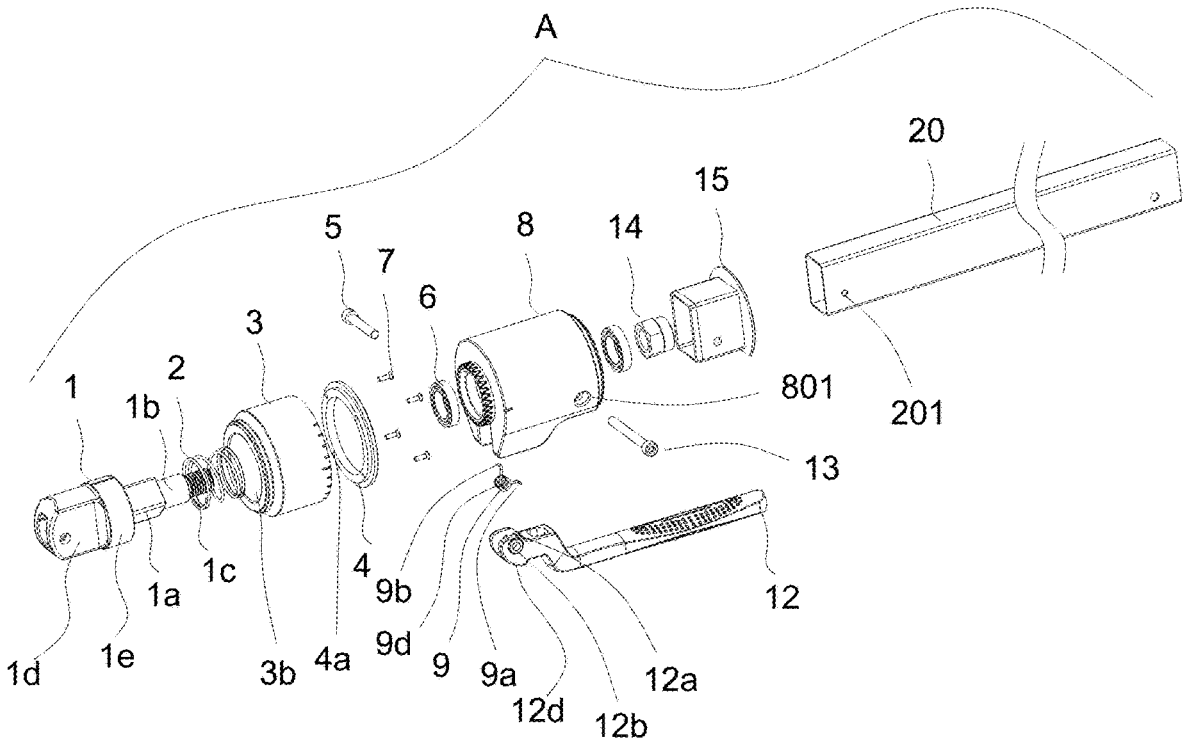
FIG. 3 is an exploded view of FIG. 2 according to the embodiment of the present invention.
Figure 4:
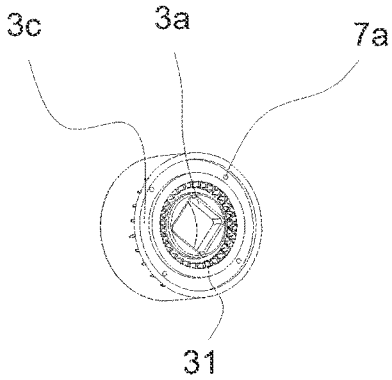
FIG. 4 is a perspective view of an upper surface of a lower clutch gear in FIG. 2 according to the embodiment of the present invention.
Figure 5:
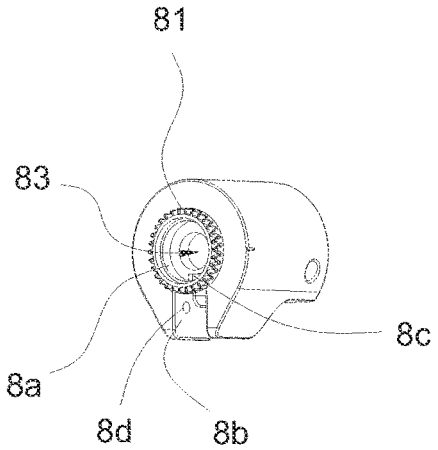
FIG. 5 is a perspective view of a lower surface of an upper clutch gear in FIG. 2 according to the embodiment of the present invention.
Figure 6:
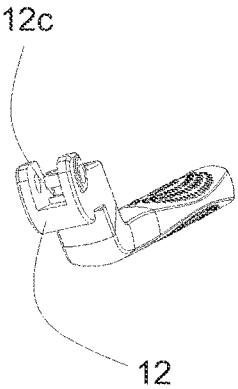
FIG. 6 is a perspective view of a handle according to the embodiment of the present invention.
Figure 7:
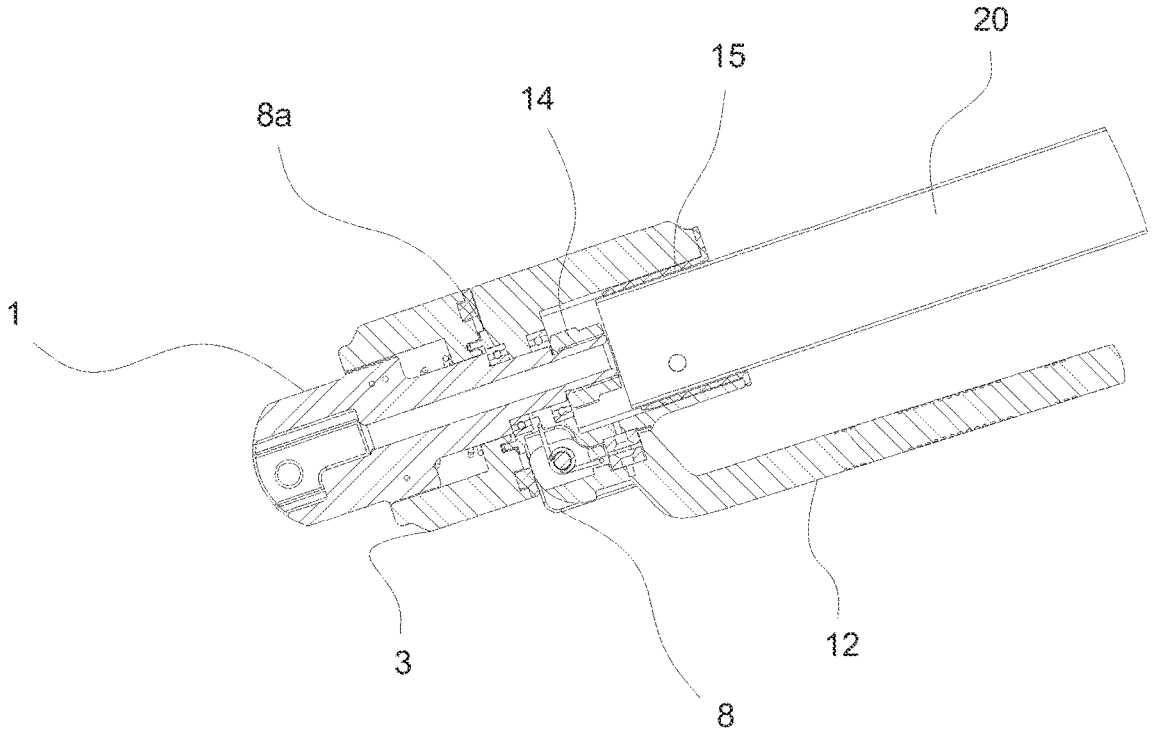
FIG. 7 is a longitudinal sectional view of FIG. 2 according to the embodiment of the present invention.
Figure 8:
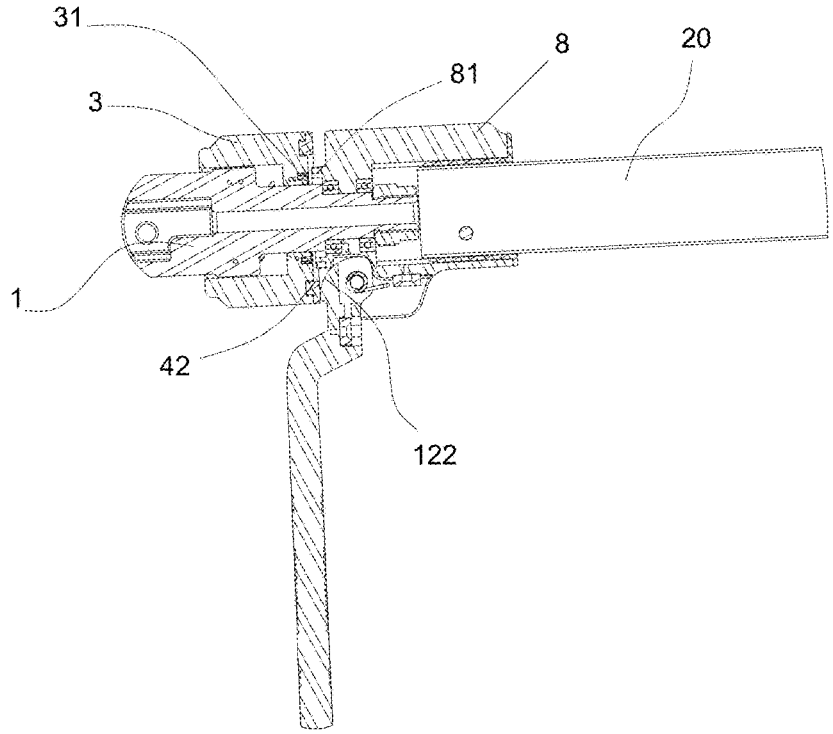
FIG. 8 is a sectional view when the handle is rotated downward to separate the lower clutch gear from the upper clutch gear according to the embodiment of the present invention.
Figure 9:
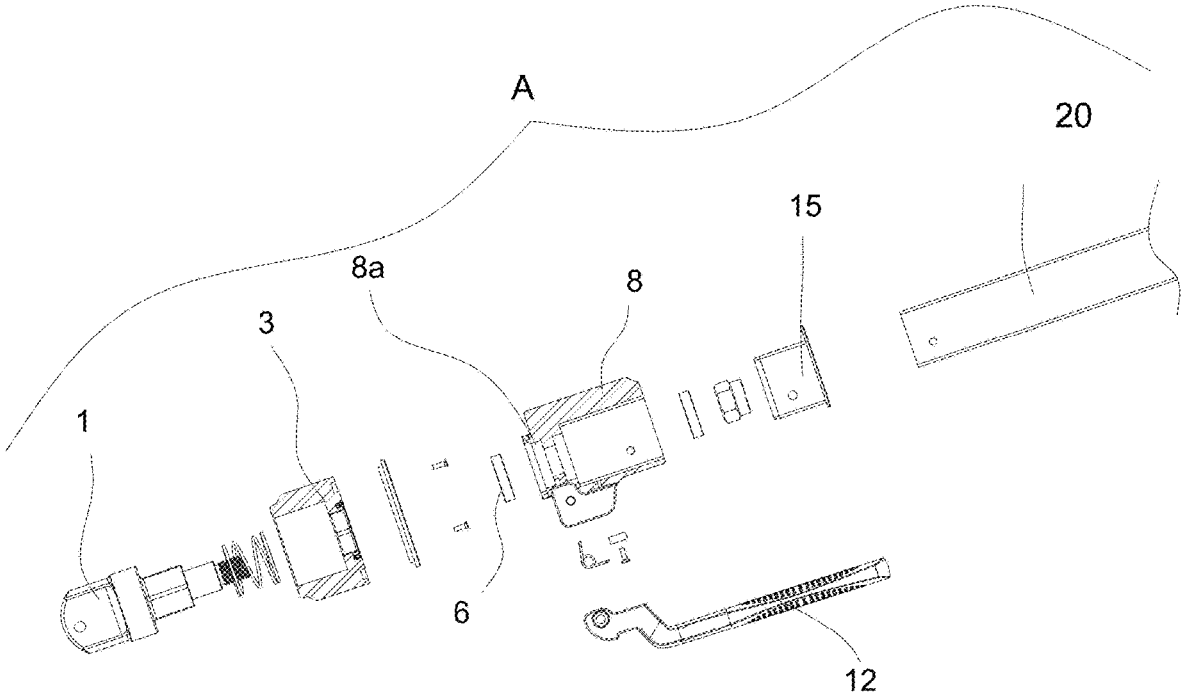
FIG. 9 is an exploded view of FIG. 7 according to the embodiment of the present invention.
Figure 10:
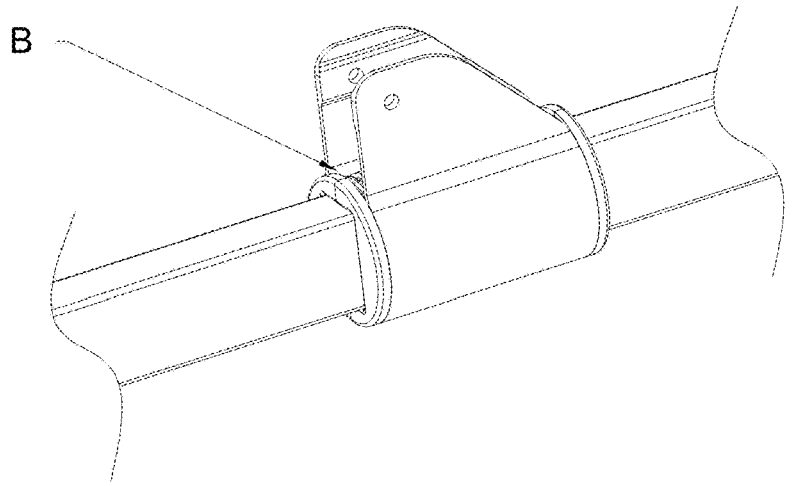
FIG. 10 is an enlarged view of Part-B showing the transverse rod rotation device in FIG. 1 according to the embodiment of the present invention.
Figure 11:
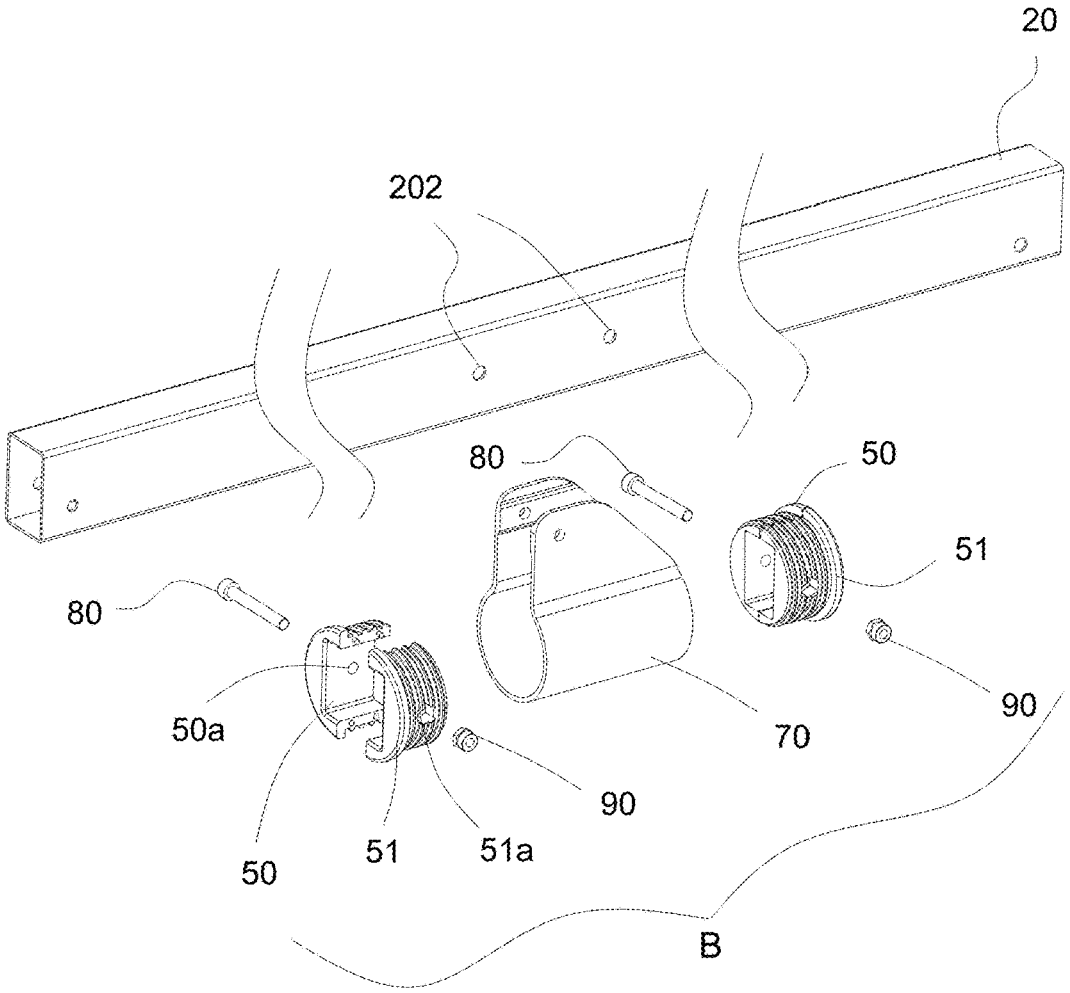
FIG. 11 is an exploded view of FIG. 10 according to the embodiment of the present invention.

As shown in FIGS. 1-11, an umbrella with an adjustable canopy comprises a column 100, a transverse rod 20 having a top end and a bottom end, a tilted rod 300 having a rear end and a front end, an umbrella frame 400, a sliding block 200, a canopy adjustment device A and a transverse rod rotation device B. The column 100 is a special-shaped pipe, such as a pipe with an irregular section; the sliding block 200 is mounted on the column 100 and can slide up and down along the column 100; the bottom end of the transverse rod 20 is rotatably connected to the sliding block 200 through the canopy adjustment device A; the canopy adjustment device A can rotate up and down in a mounted hole of the sliding block 200, and the umbrella frame 400 is disposed on the top end of the transverse rod 20. The transverse rod rotation device B is mounted on the middle of the transverse rod 20, the rear end of the tilted rod 300 is rotatably mounted on the top of the column 100, and the front end of the tilted rod 300 is rotatably connected to the transverse rod rotation device B.

The canopy adjustment device A comprises a transverse rod connector 1 having a top end and a bottom end, an upper clutch gear 8, a lower clutch gear 3 surrounding the transverse rod connector 1 and having an upper surface, a clutch gear cover 15 and a handle 12. The upper clutch gear 8 is fixedly connected to the transverse rod 20, the bottom end of the transverse rod connector 1 is rotatably connected to the sliding block 200. The top end of the transverse rod connector 1 passes through the lower clutch gear 3 and is rotatably connected to the upper clutch gear 8; the lower clutch gear 3 moves along the axis of the transverse rod connector 1 to engage or disengage with the upper clutch gear 8, and one end of the handle 12 is rotatably connected to the periphery the upper clutch gear 8, which is against the upper surface of the lower clutch gear 3 by using a cam surface 12*d*. When the handle 12 is rotated downward, the handle 12 drives the lower clutch gear 3 to move downward and separate from the upper clutch gear 8, then, when the handle 12 is rotated leftward or rightward, the transverse rod 20 and the umbrella frame 400 is driven to move leftward or rightward for achieve a canopy adjustment.

The specific structure is as follows: each of the upper clutch gear 8 and the lower clutch gear 3 is a sleeve and has a through hole, the upper clutch gear 8 has a circular hole 83 at the bottom end thereof for the transverse rod connector 1 to pass through, and the lower clutch gear 8 has a square hole 3*a* at the upper end thereof for receiving the top of the transverse rod connector 1; the upper clutch gear 8 has a circular protruding teeth 81 around the circular hole; the lower clutch gear 3 has a circular convex teeth 31 around the square hole 3*a* at the top end thereof for engaging with the circular protruding teeth 81; the transverse rod connector 1 has a square portion matching with the square hole 3*a* of the lower clutch gear 3, the top of the transverse rod connector 1 passes through the square hole 3*a* of the lower clutch gear 3 and the circular hole 83 of the upper clutch gear 8, and a nut 14 located inside through hole of the upper clutch gear 8 is screwed on the top of the transverse rod connector 1, the lower clutch gear 3 and the upper clutch gear 8 are positioned around the transverse rod connector 1; a spring 2 is supported between the inner wall of through hole of the lower clutch gear 3 and the transverse rod connector 1, so as to push the lower clutch gear 3 to move upward and engage with the upper clutch gear 8. The transverse rod connector 1 is defined with five sections from the bottom to the top, those are a first section 1*d*, a second section 1*e*, a third section 1*a*, a fourth section 1*b*, a fifth section 1*c*; the first section 1*d* is a connecting section connected with the sliding block 200, the second section 1*e* is a cylindrical section matching the through hole 3*b* of the lower clutch gear 3, and the third section 1*a* in the middle of the transverse rod connector 1 is a square column section matching the square hole 3*a* of the lower clutch gear 3, the fourth section 1*b* is a reduced cylindrical section matching the circular hole 83 of the upper clutch gear 8, and the fifth section 1*c* is an external thread section matching the nut 4. The spring 2 is located in the inner hole 3*b* of the lower clutch gear 3 and is sleeved on the third section 1*a* of the transverse rod connector 1, two ends of the spring 2 respectively resist against the inner side of the square hole 3*a* of the lower clutch gear 3, and the front surface of the second section 1*e* of the transverse rod connector 1. In this way, the lower clutch gear 3 can only move along the axis of the transverse rod connector 1 on the transverse rod connector 1 and cannot rotate. The upper clutch gear 8 has two fixed grooves 8*a* each for receiving bearings 6 respectively disposed on the top end and the bottom end of the circular hole 83; the top end of the transverse rod connector 1 passes through the spring 2 and the upper clutch gear 8 and is located inside the bearings 6; the third section 1*a* of the transverse rod connector 1 is positioned resisting against the bearing 6 at the bottom end of the upper clutch gear 8, the fourth section 1*b* of the transverse rod connector 1 fits closely with the bearing 6. The upper clutch gear 8 has a handle groove 8*b* for receiving a top end of the handle 12 at the bottom end of the upper clutch gear 8 and a positioning notch 8*c* for receiving a fork 9*b* of a torsion spring 9. The top end of the handle 12 has a U-shaped rotating groove 12*a* for the rotation of the torsion spring 9 and a positioning notch 12*c* of the end of another fork 9*a* of the torsion spring 9, and has a cam surface 12*d*. The top end of the handle 12 transversely has a through hole 12*b*, and the two sides of the handle groove 8*b* has corresponding rotating holes 8*d*; the torsion spring 9 is disposed in the rotating groove 12*a* of the handle 12, the end of the fork 9*a* of the torsion spring 9 is disposed in the positioning notch 12*c* of the handle 12, the handle torsion spring assembly is disposed in the handle groove 8*b* of the upper clutch gear 8, the end of the fork 9*b* of the torsion spring 9 is disposed in the positioning notch 8*c* of the upper clutch gear 8. A screw 5 passes through the rotating holes 8*d*, the handle through hole 12*b* of the handle 12 and the center hole 9*d* of the torsion spring 9 so as to make the handle 12 and the torsion spring 9 be positioned on the upper clutch gear 8. The fork 9*a* and the fork 9*b* of the torsion spring 9 form an acute angle. When the handle 12 is rotated, the torsion spring 9 has a tendency to return, enabling the handle 12 to return to its initial position.

A washer 4 in sliding connected to the top end of the handle 12 is disposed on the top surface of the lower clutch gear 3; the upper end face of the lower clutch gear 3 has a groove 3*c* for disposing the washer, the washer 4 has a connecting hole 4*a* in a ring, and the groove 3*c* has a corresponding internal thread hole 7*a*. The washer 4 is fixed in the groove 3*c* of the lower clutch gear 3 by making a screw 7 pass through the connecting hole 4*a* on the washer 4.

The bottom end of the upper clutch gear 8 has a mark line 82 at the periphery thereof; the lower clutch gear 3 has a scale mark 32 disposed around the top end of the lower clutch gear 3, which is matched with the mark line 82 to observe the left and right rotation angles.

The upper clutch gear 8 has a clutch gear cover 15 at the top end thereof, the transverse rod 20 is a hollow square tube; the clutch gear cover 15 has a square hole for receiving the transverse rod 20; the bottom end of the transverse rod 20 has a connecting hole 201; the top end of the upper clutch gear 8 has a corresponding transverse rod fixing hole 801 and the clutch gear cover 15 has a corresponding through hole; the transverse rod 20 and the clutch gear cover 15 are positioned on the upper clutch gear 8 through a screw 13.

The transverse rod rotation device B comprises a plurality pair of left rotation bushing 50 and right rotation bushing 51 and a tilted rod connector 70; each of the left and right rotation bushings 50,51 is in semicircular, and one pair of the left and right rotation bushings 50, 51 face to face assembled forms a clamp with a square hole matching with the transverse rod 20; the middle of the transverse rod 20 has a through mounting hole 202, the middle of the left and right rotation bushings 50, 51 has a plurality of corresponding through holes 50*a*, 51*a*; the left and right rotation bushings 50, 51 are clamped at the left and right sides of the middle of the transverse rod 20 and are positioned with the transverse rod 20 through a screw 80 and a nut 90; the tilted rod connector 70 is rotatably sleeved out of the left and right rotation bushings 50, 51, the tilted rod connector 70 is a circle matching with the left and right rotation bushings 50, 51, and the top of the tilted rod connector 70 is rotatably connected to the bottom end of the tilted rod 300. Two pairs of the left and right rotation bushings 50, 51 are respectively located at the two ends of the tilted rod connector 70; and each pair of left and right rotation bushings 50, 51 has a protruding edge resisting against one end of the circular tilted rod connector 70, each pair of the left and right rotation bushings 50, 51 has circular concave convex texture at the peripheral surface thereof which is convenient for increasing friction. When the tilted rod connector 70 and the tilted rod 300 are connected, the transverse rod 20 can rotate in the tilted rod connector 70.

The specific operation process of the present invention is as follows: when the handle 12 is pulled down, a face 122 of the head of the handle 12 and a face 42 of the washer 4 slide into contact. The handle 12 can make the lower clutch gear 3 moves backward, so that the inner ring gear 31 of the lower clutch gear 3 is separated from the convex gear 81 of the upper clutch gear 8, and then the rotation restraint of the transverse rod 20 can be released. When the handle 12 is rotated leftward or rightward, the upper clutch gear 8 drives the transverse rod 20 to rotate facing the rotating lower clutch gear 3. When it is rotated to a certain position, release the handle 12. Under the action of the spring 2 and the torsion spring 9, the handle 12 and the lower clutch gear 3 returns to the original engagement state, so as to make the canopy be positioned at a certain angle.

The protection scope of the present invention is not limited to each embodiments described in this description. Any changes and replacements made on the basis of the scope of the present invention patent and of the description shall be included in the scope of the present invention patent.

The invention claimed is:

1. An umbrella with an adjustable canopy, comprising:
- a column (100);
- a sliding block (200) slidably mounted onto the column (10);
- an umbrella frame (400);
- a transverse rod (20) having a top end and a bottom end;
- a tilted rod (300) having a rear end and a front end;
- a canopy adjustment device (A) for controlling rotation of the umbrella frame (400);
- a transverse rod rotation device (B) mounted on a middle of the transverse rod (20), permitting rotation of the transverse rod (20) when the tilted rod (300) is stationary;

wherein,
- the bottom end of the transverse rod (20) is rotatably connected to the sliding block (200) through the canopy adjustment device (A), the top end of the transverse rod (20) is rotatably connected to a top of the umbrella frame (400);
- the rear end of the tilted rod (300) is connected to a top of the column (100), and the front end of the tilted rod (300) is rotatably connected to the middle of the transverse rod (20);
- the front end of the tilted rod (300) is rotatably connected to the transverse rod rotation device (B);
- the canopy adjustment device (A) comprises a transverse rod connector (1) having a top end and a bottom end, a lower clutch gear (3) surrounding the transverse rod connector (1) and having an upper surface, an upper clutch gear (8) and a handle (12);
- the upper clutch gear (8) is fixed to the transverse rod (20);
- the top end of the transverse rod connector (1) passes through the lower clutch gear (3) and is rotatably connected to the upper clutch gear (8);
- the lower clutch gear (3) moves along an axis of the transverse rod connector (1) to engage or disengage with the upper clutch gear (8);
- one end of the handle (12) is rotatably connected to a periphery of the upper clutch gear (8), which is against an upper surface of the lower clutch gear (3);
- when the handle (12) is rotated downward, the handle (12) drives the lower clutch gear (3) to move downward and separate from the upper clutch gear (8), then, when the handle (12) is rotated leftward or rightward, the transverse rod (20) and the umbrella frame (400) are driven to move leftward or rightward to adjust the canopy,
- each of the upper clutch gear (8) and the lower clutch gear (3) is a sleeve and has a through hole, the upper clutch gear (8) has a circular hole (83) at the bottom end thereof for the transverse rod connector (1) to pass through, and the lower clutch gear (3) has a square hole (3*a*) at the upper end thereof for receiving the top end of the transverse rod connector (1);
- the upper clutch gear (8) has a ring of protruding teeth (81) around the circular hole (83), the lower clutch gear (3) has a ring of convex teeth (31) around the square hole (3*a*) at the top end thereof for engaging with the ring of protruding teeth (81);
- the transverse rod connector (1) has a square portion matching with the square hole (3*a*) of the lower clutch gear (3), the top end of the transverse rod connector (1) passes through the square hole (3*a*) of the lower clutch gear (3) and the circular hole (83) of the upper clutch gear (8), and a nut (14) located inside the through hole of the upper clutch gear (8) is screwed on the top end of the transverse rod connector (1), the lower clutch gear (3) and the upper clutch gear (8) are positioned around the transverse rod connector (1);
- a spring (2) is supported between the inner wall of through hole of the lower clutch gear (3) and the transverse rod connector (1), so as to push the lower clutch gear (3) to move upward and engage with the upper clutch gear (8).

2. The umbrella of claim 1, wherein the transverse rod connector (1) is defined with five sections from the bottom to the top, the five sections being a first section (1*d*), a second section (1*e*), a third section (1*a*), a fourth section (1*b*), and a fifth section (1*c*);

the first section (1*d*) is a connecting section connected with the sliding block (200), the second section (1*e*) is a cylindrical section matching the through hole (3*b*) of the lower clutch gear (3), and the third section (1*a*) in the middle of the transverse rod connector (1) is a square column section matching the square hole (3*a*) of the lower clutch gear (3), the fourth section (1*b*) is a reduced cylindrical section matching the circular hole (83) of the upper clutch gear (8), and the fifth section (1*c*) is an external thread section matching the nut (4);

the spring (2) is sleeved on the third square column section (1*a*) of the transverse rod connector (1), two ends of the spring (2) respectively resist against the inner side of the square hole (3*a*) of the lower clutch gear (3), and the front surface of the second section (1*e*) of the transverse rod connector (1).

3. The umbrella of claim 2, wherein the upper clutch gear (8) has two fixed grooves (8*a*) each for receiving bearings (6) respectively disposed on the top end and the bottom end of the circular hole (83);

the top end of the transverse rod connector (1) passes through the spring (2) and the upper clutch gear (8) and is located inside the bearings (6);

the third section (1*a*) of the transverse rod connector (1) is positioned resisting against the bearing (6) at the bottom end of the upper clutch gear (8), the fourth section (1*b*) of the transverse rod connector (1) fits closely with the bearing (6).

4. The umbrella of claim 3, wherein the upper clutch gear (8) has a handle groove (8*b*) for receiving a top end of the handle (12) at the bottom end of the upper clutch gear (8), the top end of the handle (12) is U-shaped and has a cam surface (12*d*);

the top end of the handle (12) has a transverse handle through hole (12*b*), the upper clutch gear (8) has a corresponding rotating holes (8*d*) at each of two sides of the handle groove (8*b*);

a torsion spring (9) having a center hole (9*d*) matched with the handle (12) is disposed between the top end of the handle (12) and the handle groove (8*b*);

a screw (5) passes through the rotating holes (8*d*), the handle through hole (12*b*) of the handle (12) and the center hole (9*d*) of the torsion spring (9) so as to make the handle (12) and the torsion spring (9) be positioned on the upper clutch gear (8).

5. The umbrella of claim 4, wherein a washer (4) in sliding connection to the top end of the handle (12) is disposed on the top surface of the lower clutch gear (3).

6. The umbrella of claim 5, wherein the upper clutch gear (8) has a clutch gear cover (15) at the top end thereof, the transverse rod (20) is a hollow square tube;

the clutch gear cover (15) has a square hole for receiving the transverse rod (20), the bottom end of the transverse rod (20) has a connecting hole (201), the top end of the upper clutch gear (8) has a corresponding transverse rod fixing hole (801) and the clutch gear cover (15) has a corresponding through hole;

the transverse rod (20) and the clutch gear cover (15) are positioned on the upper clutch gear (8) through a screw (13).

7. The umbrella of claim 1, wherein the transverse rod rotation device (B) comprises a plurality pair of left rotation bushing (50) and right rotation bushing (51) and a tilted rod connector (70);

each of the left and right rotation bushings (50,51) is in semicircular shape, and one pair of the left and right rotation bushings (50, 51) assembled face to face forms a clamp with a square hole matching with the transverse rod (20);

the middle of the transverse rod (20) has a through mounting hole (202), a middle of the left and right rotation bushings (50, 51) has a plurality of corresponding through holes (50*a*, 51*a*);

the left and right rotation bushings (50, 51) are clamped at the left and right sides of the middle of the transverse rod (20) and are positioned with the transverse rod (20) through a screw (80) and a nut (90);

the tilted rod connector (70) is rotatably sleeved out of the left and right rotation bushings (50, 51), the tilted rod connector (70) is a circle matching with the left and right rotation bushings (50, 51), and the top of the tilted rod connector (70) is rotatably connected to the bottom end of the tilted rod (300).

8. The umbrella of claim 7, wherein two pairs of the left and right rotation bushings (50, 51) are respectively located at the two ends of the tilted rod connector (70);

and each pair of left and right rotation bushings (50, 51) has a protruding edge resisting against one end of the circular tilted rod connector (70), each pair of the left and right rotation bushings (50, 51) has circular concave convex texture at the peripheral surface thereof which increase friction.

9. The umbrella of claim 1, wherein the bottom end of the upper clutch gear (8) has a mark line (82) at the periphery thereof;

the lower clutch gear (3) has a scale mark (32) disposed around the top end of the lower clutch gear (3), which is matched with the mark line (82) to observe the left and right rotation angles.

* * * * *